US006257946B1

(12) United States Patent
Yang

(10) Patent No.: US 6,257,946 B1
(45) Date of Patent: Jul. 10, 2001

(54) TOY AIRPLANE

(76) Inventor: Ming-Ting Yang, No. 22, Hankou S. 2nd St., Taichung City (TW)

( * ) Notice: Subject to any disclaimer, the term of this patent is extended or adjusted under 35 U.S.C. 154(b) by 0 days.

(21) Appl. No.: 09/471,098

(22) Filed: Dec. 23, 1999

(51) Int. Cl.[7] ..... A63H 27/00
(52) U.S. Cl. ..... 446/34; 446/61; 446/93
(58) Field of Search ..... 446/34, 88, 61, 446/63, 64, 66–68; 434/372; 428/43; 244/16, 48, 131

(56) References Cited

U.S. PATENT DOCUMENTS

| | | | | |
|---|---|---|---|---|
| 1,420,194 | * | 6/1922 | Howard | 446/67 |
| 2,347,561 | * | 4/1944 | Howard et al. | 446/88 |
| 2,361,929 | * | 11/1944 | De Florez | 434/372 |
| 2,551,340 | * | 5/1951 | Sands, Jr. | 446/88 |
| 2,555,670 | * | 6/1951 | Babcock | 446/88 |
| 2,870,568 | * | 1/1959 | Bergstrand | 446/34 |
| 3,369,319 | * | 2/1968 | Brown | 446/64 |
| 4,253,897 | * | 3/1981 | Pistone | 446/34 |
| 4,270,301 | * | 6/1981 | Meek | 446/88 |
| 4,458,442 | * | 7/1984 | McDaniel | 446/66 |
| 5,007,875 | * | 4/1991 | Dasa | 446/66 |
| 5,853,312 | * | 12/1998 | Li | 446/61 |

* cited by examiner

*Primary Examiner*—Jacob K. Ackun, Jr.
*Assistant Examiner*—Urszula M. Cegielnik
(74) *Attorney, Agent, or Firm*—Rosenberg, Klein & Lee

(57) ABSTRACT

A toy airplane includes a fuselage and a main wing fastened to the fuselage, the fuselage having a top clamping strip at a front side thereof, a vertical stabilizer at a rear side thereof, a plug strip spaced between the top clamping strip and the vertical stabilizer, a first retaining notch disposed between the top clamping strip and the plug strip, and a second retaining notch disposed between the plug strip and the vertical stabilizer, the main wing having two parallel front tips attached to the top clamping strip of the fuselage at two opposite sides, a first retaining notch longitudinally extended to a front side thereof and defined between the front tips and forced into engagement with the first retaining notch on the fuselage, a second retaining notch longitudinally extended to a rear side thereof and forced into engagement with the second retaining notch on the fuselage, and an elongated plug hole longitudinally disposed on the middle and engaged with the plug strip of the fuselage.

1 Claim, 8 Drawing Sheets

TOY AIRPLANE

BACKGROUND OF THE INVENTION

The present invention relates to a toy airplane that flies when thrown into the air, and more particularly to such a toy airplane, which is made by clamping component parts to one another that are obtained from a sheet member by stamping.

FIGS. 1 and 2 show a prior art toy airplane that flies when thrown into the air. This structure of toy airplane is comprised of a fusclage 1, a main wing 4, and an elevator 5. The fuselage 1 comprises a wing slot 2, an elevator slot 3, and a vertical stabilizer 6. The main wing 4 and the elevator 5 are respectively fastened to the wing slot 2 and the elevator slot 3. This structure of toy airplane has numerous drawbacks as outlined hereinafter.

1. The whole design of the toy airplane is monotonous and less attractive. This design does not allow additional airplane accessories to be attached to the fuselage or the main wing.
2. Because the main wing and the elevator are respectively plugged into the wing slot and the elevator slot and no retainer means is provided to secure the connection between the fuselage and the main wing/elevator, the main wing or elevator may fall out of the fuselage when the toy airplane is thrown into the air.
3. The limited area of the main wing and the elevator cannot help the toy fuselage fly in the air for long.
4. This design of toy airplane cannot be equipped with a delta wing.

If a long wing slot is made on the fuselage for the installation of a delta wing, the structural strength of the fuselage will be destroyed.

SUMMARY OF THE INVENTION

It is one object of the present invention provides a toy airplane, which eliminates the aforesaid drawbacks. It is one object of the present invention to provide a toy airplane, which has a strong structural strength. It is another object of the present invention to provide a toy airplane, which is equipped with a delta wing and a tail fin. It is still another object of the present invention to provide a toy airplane, which is equipped with elevators for a long flight in the air. It is still another object of the present invention to provide a toy airplane, which is equipped with auxiliary wings for long fly in the air. It is still another object of the present invention to provide a toy airplane, which is equipped with a heavy nose that keeps the toy airplane in balance when flying. According to one aspect of the present invention, the toy airplane comprises s a fuselage and a main wing fastened to the fuselage. The fuselage comprises a top clamping strip at a front side thereof, a vertical stabilizer at a rear side thereof, a plug strip spaced between the top clamping strip and the vertical stabilizer, a first retaining notch disposed between the top clamping strip and the plug strip, and a second retaining notch disposed between the plug strip and the vertical stabilizer. The main wing comprises two parallel front tips attached to the top clamping strip of the fuselage at two opposite sides, a first retaining notch longitudinally extended to a front side thereof and defined between the front tips and forced into engagement with the first retaining notch on the fuselage, a second retaining notch longitudinally extended to a rear side thereof and forced into engagement with the second retaining notch on the fuselage, and an elongated plug hole longitudinally disposed on the middle and engaged with the plug strip of the fuselage. Because the plug strip of the fuselage is plugged into the plughole on the main wing from the bottom side and the top clamping strip and stabilizer of the fuselage are respectively clamped on the topside of the main wing, the connection between the fuselage and the main wing is stable. According to another aspect of the present invention, the main wing is a delta wing. According to still another aspect of the present invention, the main wing comprises two third retaining notches bilaterally disposed near the rear side thereof, and two auxiliary wings are respectively fastened to the third retaining notches on the main wing to improve the floating ability of the toy airplane in the air. According to still another aspect of the present invention, a retaining strip is secured to the second retaining notch on the fuselage and supported on the main wing to reinforce the connection between the stabilizer of the fuselage and the main wing. According to still another aspect of the present invention, a heavy nose is fastened to the front end of the fuselage to keep the toy airplane in balance.

DETAILED DESCRIPTION OF THE PREFERRED EMBODIMENT

Figure 1:
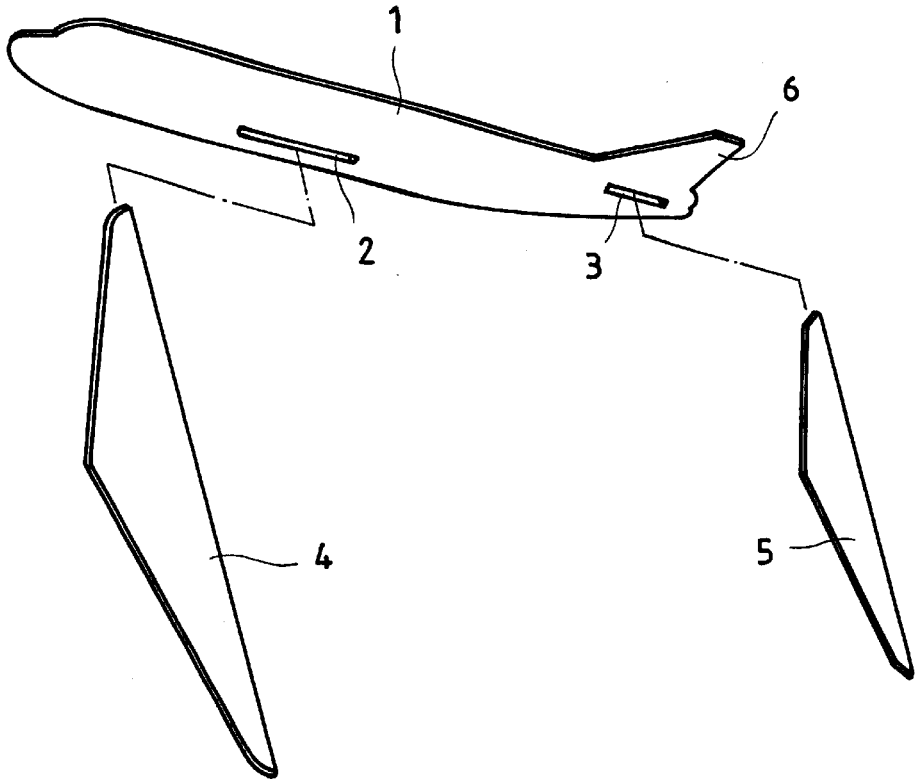
FIG.1 PRIOR ART
FIG. 1 is an exploded view of a toy airplane according to the prior art.
Figure 2:
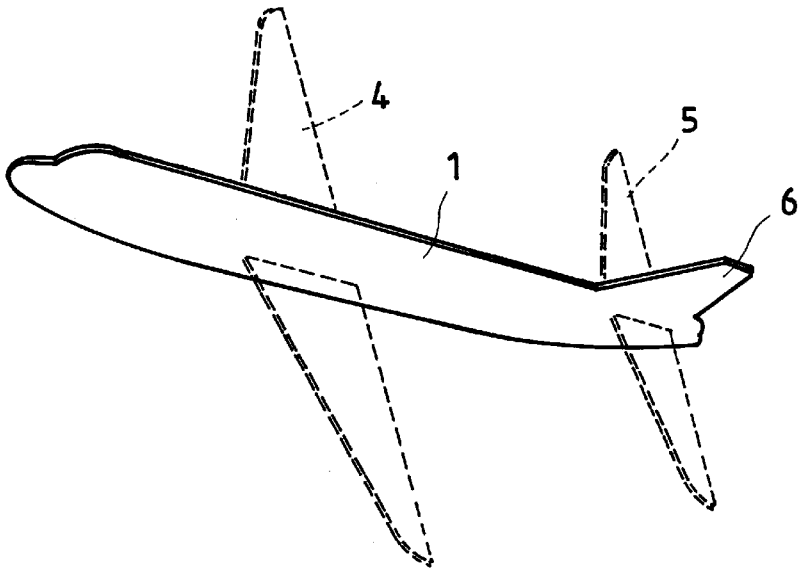
FIG.2 PRIOR ART
FIG. 2 is a schematic drawing showing the toy airplane of FIG. 1 assembled.
Figure 3:
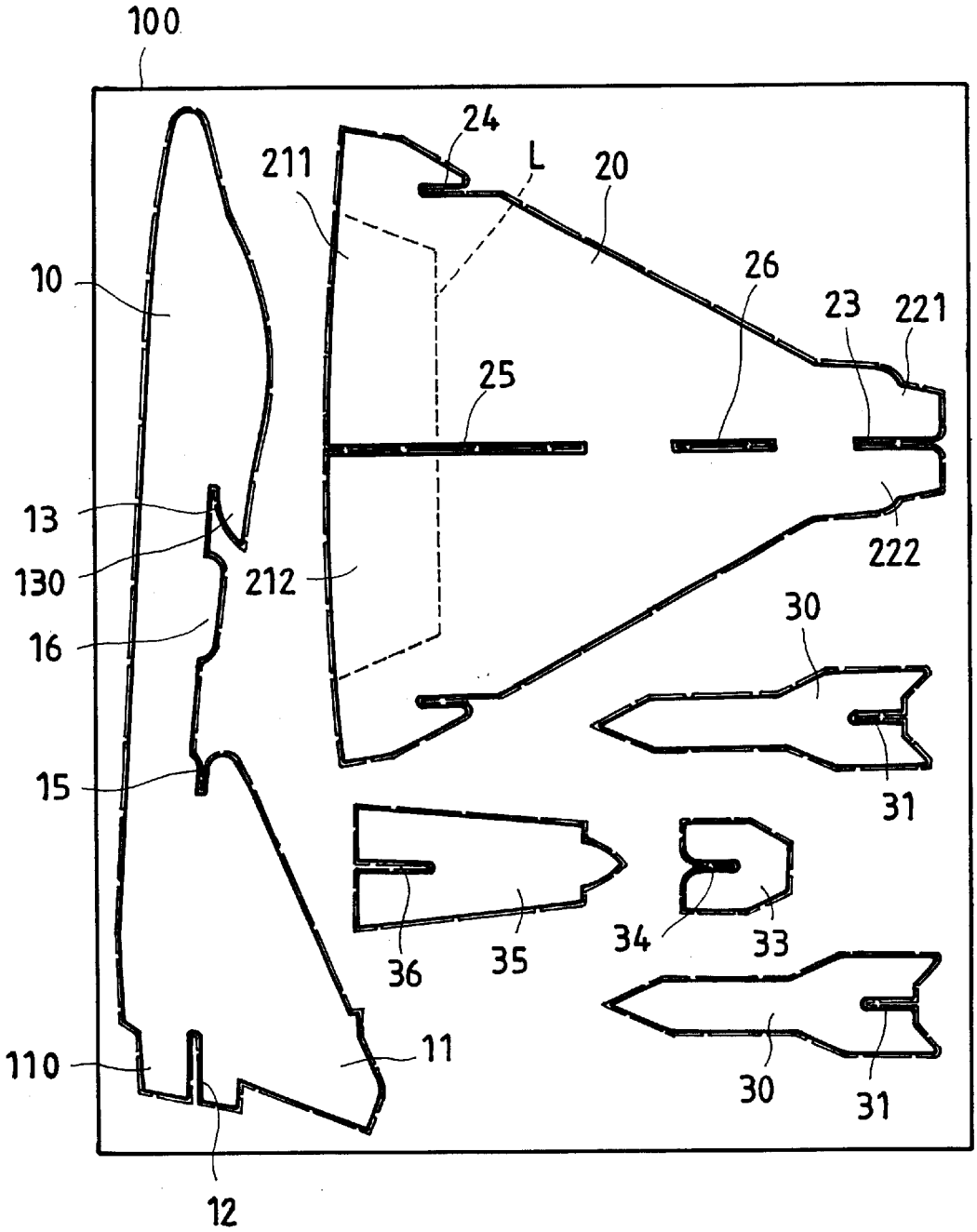
FIG. 3 illustrates a sheet member on which toy airplane parts are marked according to the present invention.
Figure 4:
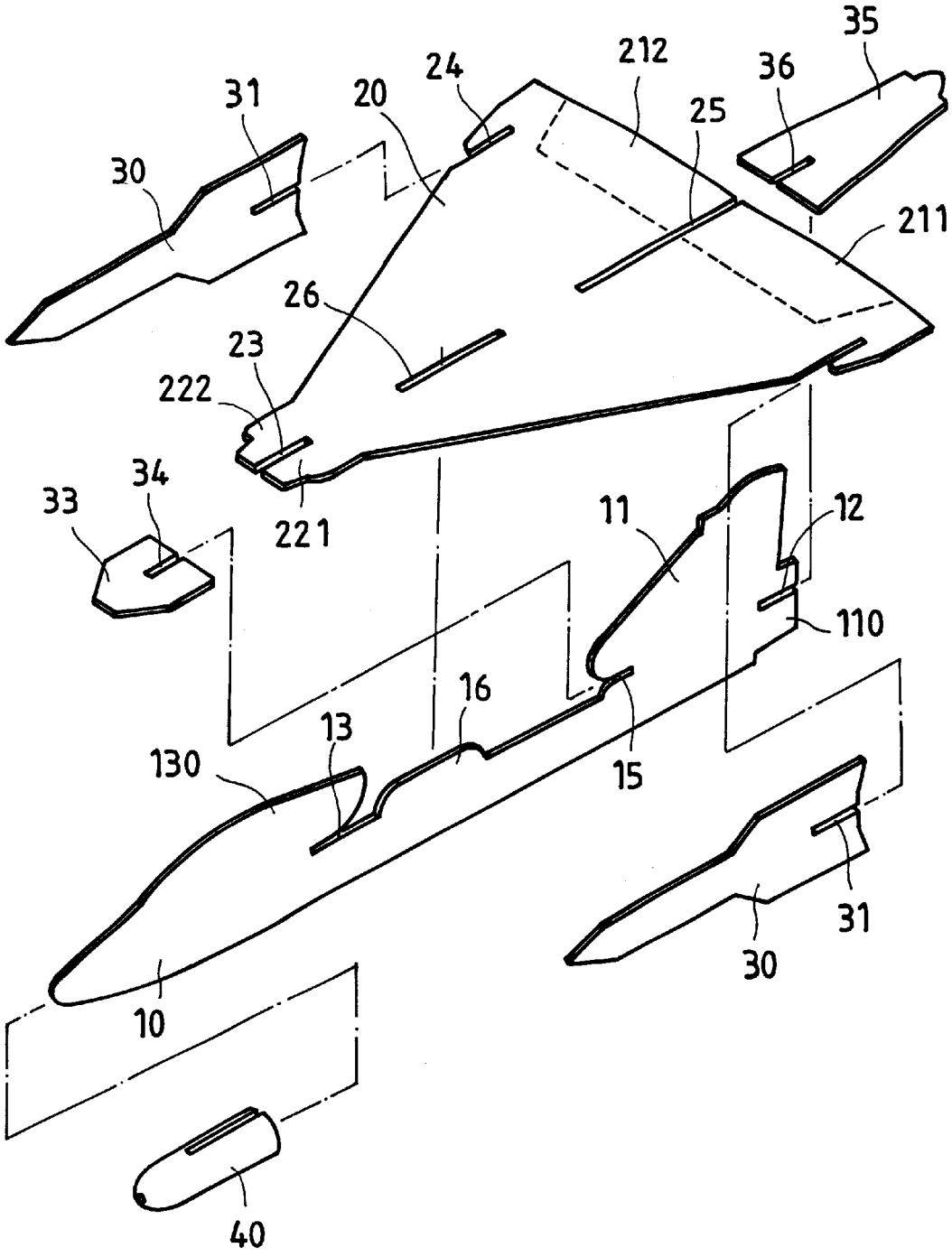
FIG. 4 is an exploded view of a toy airplane according to one embodiment of the present invention.
Figure 5:
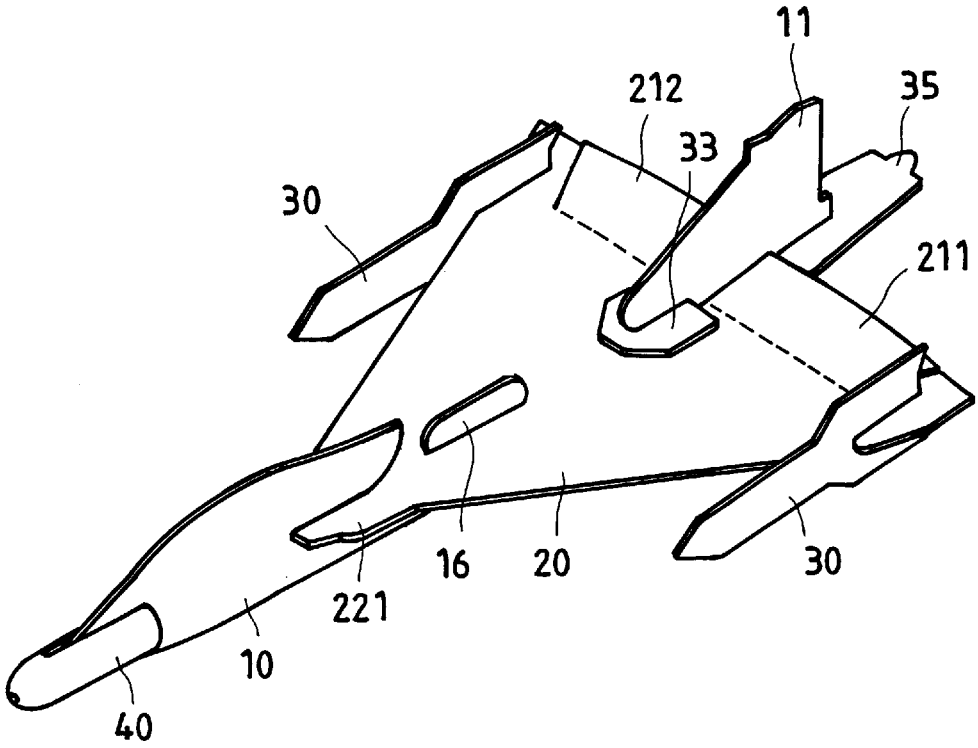
FIG. 5 illustrates the toy airplane of FIG. 4 assembled.

Referring to Figures from 3 through 5, a toy airplane in accordance with the present invention is comprised of a fuselage 10, a main wing 20, two auxiliary wings 30, a retainer strip 33, a tail fin 35, and a nose 40. The fuselage 10, the main wing 20, the auxiliary wings 30, the retainer strip 33, and the tail fin 35 are cut from a sheet member 100 by stamping.

The fuselage 10 comprises a top clamping strip 130 at a front side thereof, a vertical stabilizer 11 at a rear side, a plug strip 16 spaced between the top clamping strip 130 and the vertical stabilizer 11, a first retaining notch 13 disposed between the top clamping strip 130 and the plug strip 16, a second retaining notch 15 disposed between the plug strip 16 and the vertical stabilizer 11, a tail piece 110, and a third retaining notch 12 on the tail piece 110.

The main wing 20 is a delta wing comprising two parallel front tips 221 and 222, a front wing retaining notch 23 longitudinally extended to the front side thereof and defined between the front tips 221, 222, a rear wing retaining notch 25 longitudinally extended to the rear side thereof, an elongated plug hole 26 longitudinally disposed on the middle between the front wing retaining notch 23 and the rear wing retaining notch 25, two sloping elevator portions 211 and 212 disposed at two opposite sides of the rear wing retaining notch 25, and two wing tip retaining notches 24 bilaterally disposed near the rear side. The auxiliary wings 30 each have an auxiliary wing retaining notch 31. The tail fin 35 comprises a front retaining notch 36. The retainer strip 33 comprises a rear retaining notch 34.

Figure 6:
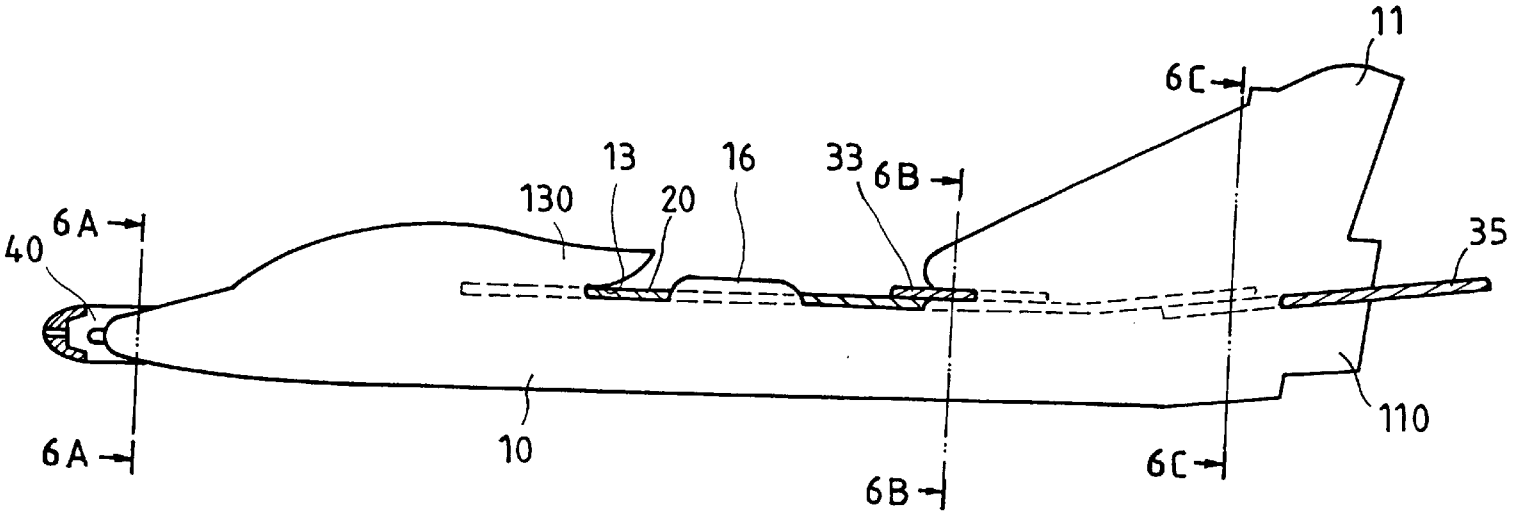
FIG. 6 is a side view in section of the toy airplane shown in FIG. 5.
Figure 6C:
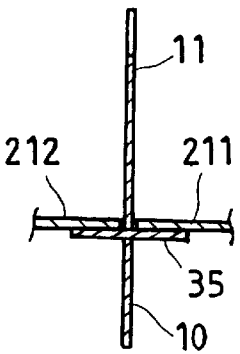
FIG. 6C is a sectional view taken along line C—C of FIG. 6.
Figure 6B:
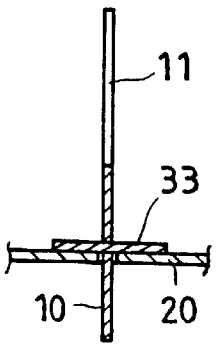
FIG. 6B is a sectional view taken along line B—B of FIG. 6.
Figure 6A:
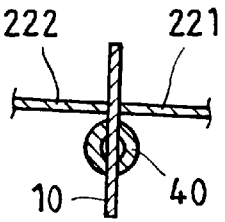
FIG. 6A is a sectional view taken along line A—A of FIG. 6.

The assembly process of the toy airplane is simple and outlined hereinafter with reference to FIG. 6 and FIGS. from 3 through 5 again. The first retaining notch 13 and second retaining notch 15 on the fuselage 10 are respectively forced into engagement with the front wing retaining notch 23 and rear wing retaining notch 25 on the main wing 20, enabling the plug strip 16 of the fuselage 10 to be plugged into the plug hole 26 on the main wing 20 from the bottom side, the front tips 221 and 222 of the main wing 20 attached to the top clamping strip 130 of the fuselage 10 at two opposite sides, and the top claiming strip 130 of the fuselage 10 clamped on the side of the main wing 20, and then the retaining strip 33 is put on the main wing 20 and fastened to the stabilizer 11 to stop the stabilizer 11 of the fuselage 10 from escaping out of the rear wing retaining notch 25 by forcing the rear retaining notch 34 of the retaining strip 33 into engagement with the second retaining notch 15 on the fuselage 10, and then the auxiliary wings 30 are respectively fastened to the main wing 20 by forcing the auxiliary wing retaining notch 31 of each auxiliary wing 30 into engagement with the wing tip retaining notches 24 on the main wing 20, and then the tail fin 35 is fastened to the tail piece 110 of the fuselage 10 by forcing the front retaining notch 36 of the tail fin 35 into engagement with the third retaining notch 12 on the tail piece 110. Furthermore, a cylindrical nose 40 is fastened to the front end of the fuselage 10. The cylindrical nose 40 has a weight that keeps the toy airplane in balance when thrown into the air.

Figure 7:
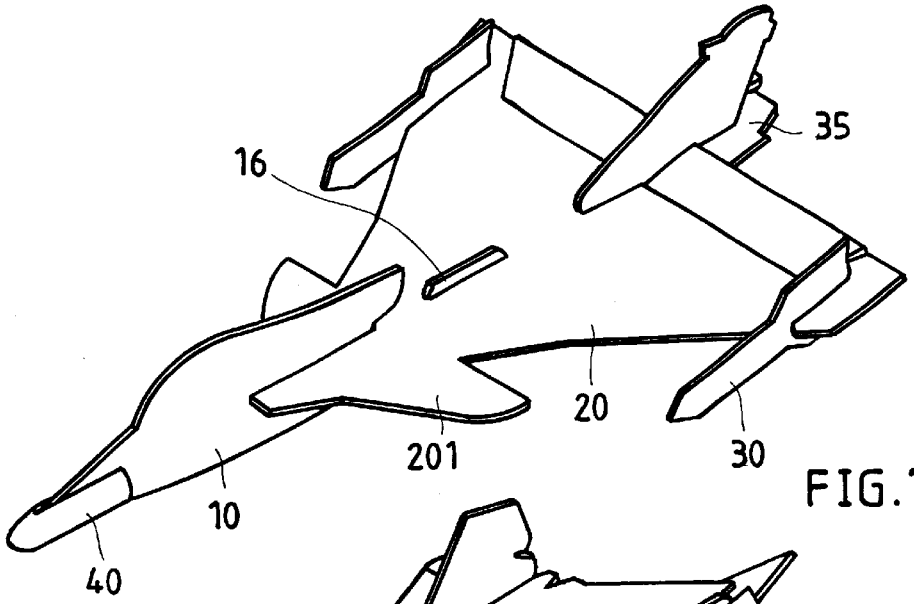
FIG. 7 is an elevational view of a toy airplane according to an alternate form of the present invention.
Figure 8:
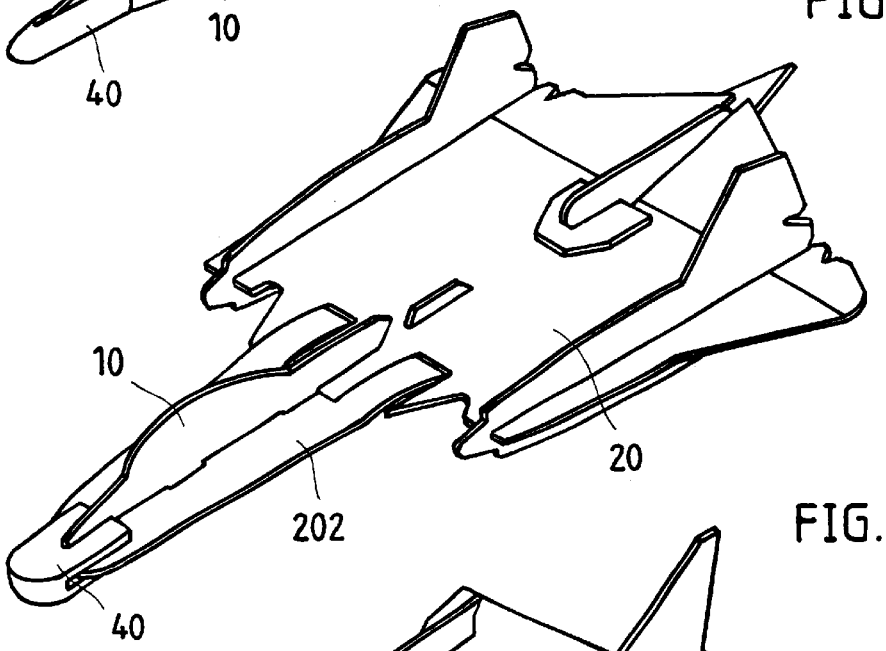
FIG. 8 is an elevational view of a toy airplane according to another alternate form of the present invention.
Figure 9:
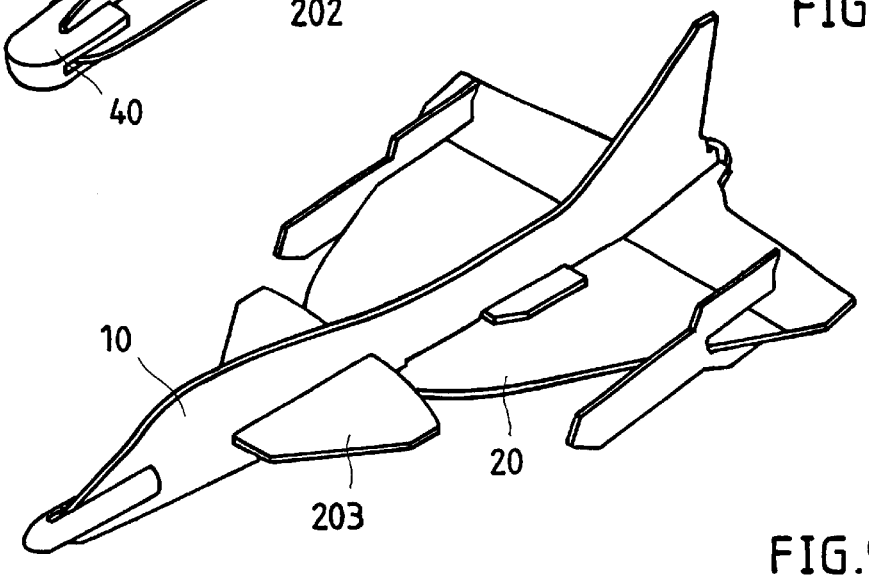
FIG. 9 is an elevational view of a toy airplane according to still another alternate form of the present invention.
Figure 10:
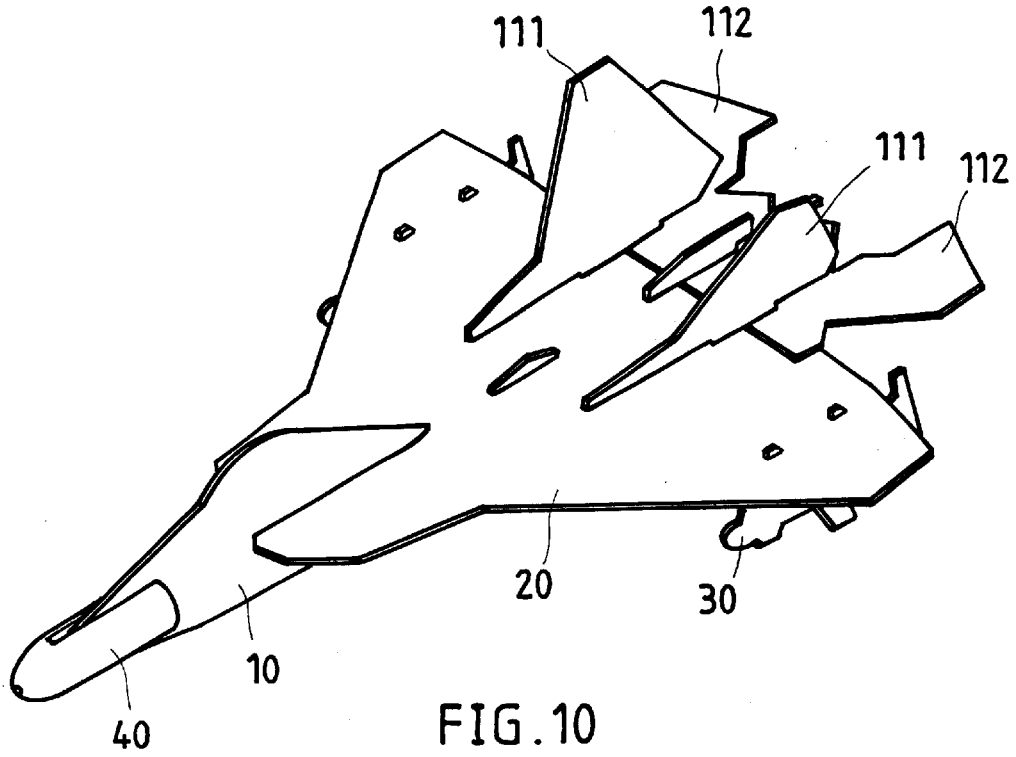
FIG. 10 is an elevational view of a toy airplane according to still another alternate form of the present invention.
Figure 10A:
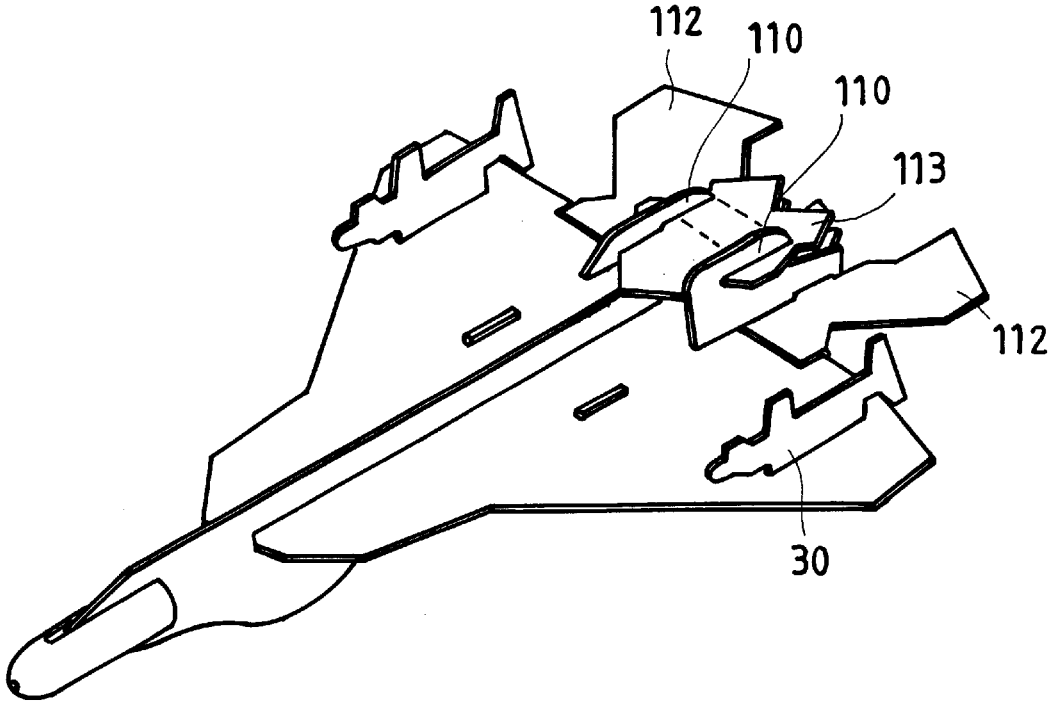
FIG. 10A is an elevational view of a toy airplane according to still another alternate form of the present invention.
Figure 11:
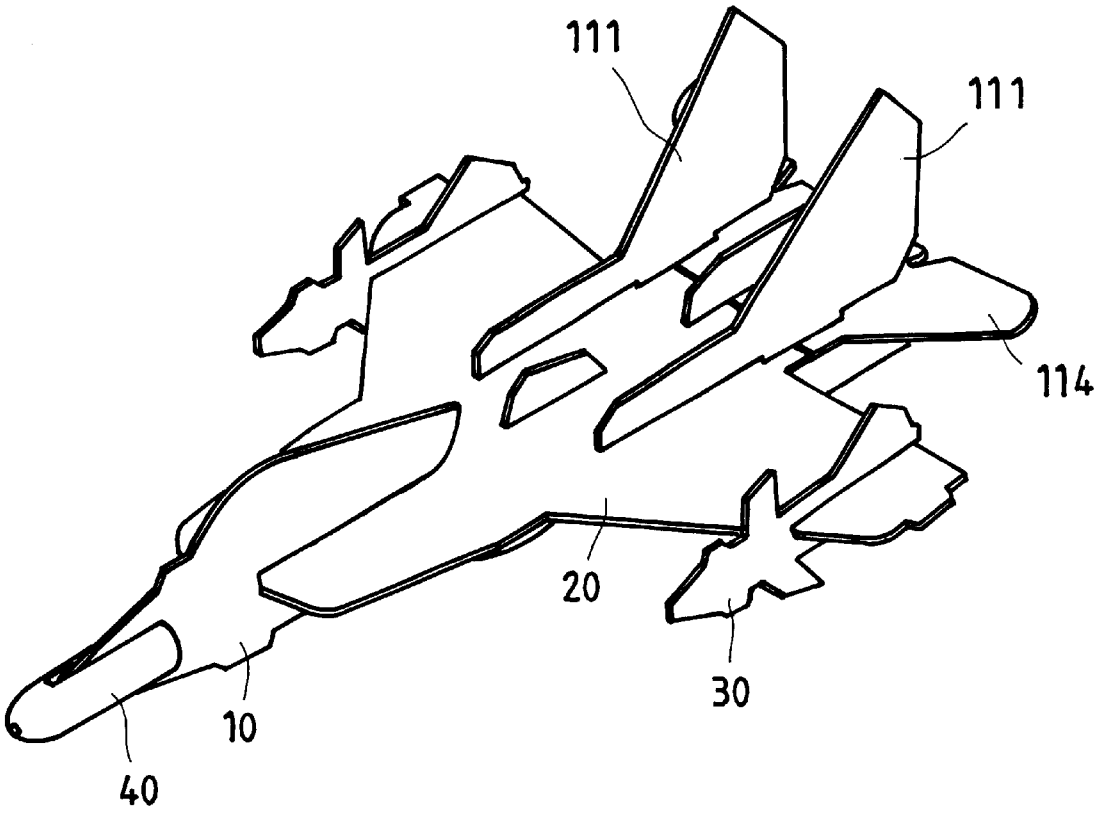
FIG. 11 is an elevational view of a toy airplane according to still another alternate form of the present invention.

FIGS. from 7 through 11 show different alternate forms of the present invention. In FIG. 7, the main wing 20 comprises two front fins 201 bilaterally disposed at the front side. In FIG. 8, the front fins 202 of the main wing 20 extend longitudinally backwards. In FIG. 9, two front fins 203 are fastened to the fuselage 10 above the main wing 20. In FIGS. 10 and 10A, two tail pieces 110 or 111 and two tail fins 112 are respectively fastened to the main wing 20 at the rear side. In FIG. 10, the vertical stabilizers 111 are respectively fastened to the main wing 20. In FIG. 10A, a connecting strip 113 is connected between the tailpieces 110. In FIG. 11, two vertical tailpieces 111 are fastened to the main wing 20 at the rear side, and a tail fin 114 is fastened to the vertical tailpieces 111.

It is to be understood that the drawings are designed for purposes of illustration only, and are not intended for use as a definition of the limits and scope of the invention disclosed.

What the invention claimed is:

1. A toy airplane comprising:

a fuselage, said fuselage including a top clamping strip at a front side thereof, a vertical stabilizer at a rear side thereof, a plug strip spaced between said top clamping strip and said vertical stabilizer, a first retaining notch disposed between said top clamping strip and said plug strip, and a second retaining notch disposed between said plug strip and said vertical stabilizer; and a main wing fastened to said fuselage, said main wing including two parallel front tips attached to the top clamping strip of said fuselage at two opposite sides, a front wing retaining notch longitudinally extended to a front side thereof and defined between said front tips and forced into engagement with the first retaining notch on said fuselage, a rear wing retaining notch longitudinally extended to a rear side thereof and forced into engagement with the second retaining notch on said fuselage, and an elongated plug hole longitudinally disposed between said front wing retaining notch and said rear wing retaining notch and engaged with the plug strip of said fuselage;

said main wing further including two sloping elevator portions disposed at two opposite sides of the rear wing retaining notch thereof, and said fuselage further including a tail piece, a third retaining notch on said tail piece, and a tail fin fastened to the third retaining notch on said tail piece below said elevator portions of said main wing.

* * * * *